United States Patent [19]

Seniuk et al.

[11] 4,015,099

[45] Mar. 29, 1977

[54] METHOD OF JOINING A COPPER CONTACT BUTTON TO THE ALUMINUM HEADBAR OF AN ELECTRODE PLATE

[75] Inventors: William Seniuk; Régis Gagnon, both of Valleyfield, Canada

[73] Assignee: Noranda Mines Limited, Toronto, Canada

[22] Filed: Feb. 21, 1975

[21] Appl. No.: 551,995

[30] Foreign Application Priority Data

Apr. 29, 1974 Canada ..... 198378

[52] U.S. Cl. ..... 219/118

[51] Int. Cl.[2] ..... B23K 9/00

[58] Field of Search ..... 219/118

[56] References Cited

UNITED STATES PATENTS

| | | | |
|---|---|---|---|
| 2,790,656 | 4/1957 | Cook | 219/118 X |
| 3,449,545 | 6/1969 | Petitt | 219/118 X |
| 3,504,158 | 3/1970 | Bliven | 219/118 X |

OTHER PUBLICATIONS

Welding Handbook, Sixth Edition, Section 1, American Weld. Society, N.Y., N.Y., 1969, pp. 5–5 8, 9 & 23.

*Primary Examiner*—E. A. Goldberg
*Attorney, Agent, or Firm*—Fleit & Jacobson

[57] ABSTRACT

A method of joining a copper contact button to the aluminum headbar of an electrode plate used in the electrolytic industry for the recovery of nonferrous metals. The method consists in the steps of coating the copper contact button with a thin layer of silver, mechanically threading the copper contact button into the aluminum headbar, preheating the assembled copper contact button and aluminum headbar to a temperature ranging from 200° to 900° F, and welding the coated copper contact button to the preheated aluminum headbar. When arc welding, preheating in the temperature range 375° to 475° F prevents oxygen from the copper diffusing into the weld.

3 Claims, 6 Drawing Figures

METHOD OF JOINING A COPPER CONTACT BUTTON TO THE ALUMINUM HEADBAR OF AN ELECTRODE PLATE

This invention relates to a method of joining a copper contact button to the aluminum headbar of a conventional electrode plate used in the electrolytic recovery of non-ferrous metals so as to achieve a strong mechanical joint having a low electrical contact resistance, and to an electrode plate produced by such method.

In the electrolytic zinc industry, for example, zinc metal is recovered by a process known as electrowinning. The zinc ions in the electrolyte contained in a cell are plated onto aluminum cathode plates under the influence of a direct current passed through the solution from inert lead anodes to the cathodes. A cell normally comprises plural interspaced anodes and cathodes and it is common practice to interconnect plural cells in series to form a so-called bank of cells. In order to form such series connection, the cathodes of one cell are connected to the anodes of the adjacent cell of the bank by means of a copper contact button which is secured to the headbar of the cathodes. Such copper contact button may be secured to the headbar by various methods but it is very important to provide a low contact resistance between the copper contact button and the aluminum headbar as well as a strong mechanical joint.

One method used by the applicant to secure the contact buttons to the headbars was to provide the contact buttons with a threaded stud and to screw such stud into the end of the headbar. This method provides a strong mechanical joint with a satisfactory low contact resistance. However, after a few months of service, the copper-aluminum junction in the threads deteriorates due to electrolytic corrosion and chemical attack and the contact resistance increases rapidly to a point where the cathode must be discarded. In addition, the threaded joint is not adequate when using mechanical strippers for removing the metal deposited on the electrode plates because the threaded joint has the tendency to loosen up after a while.

It is therefore an object of the present invention to provide a method of joining a copper contact button to an aluminum headbar wherein, in addition to the above threaded connection, the joint is reinforced by a strong metallurgical bond between the contact button and the headbar, thereby achieving a strong mechanical joint having a low and longer lasting electrical contact resistance.

The method, in accordance with the invention, comprises the steps of coating the copper contact button with a thin layer of silver, mechanically threading the copper contact button onto the aluminum headbar, preheating the assembled copper button and aluminum headbar to a temperature ranging from 200° to 900° F, and welding the coated copper contact button to the preheated aluminum headbar, whereby the mechanical joint provided by the threaded connection is reinforced by a strong metallurgical bond having a low contact resistance.

Welding is preferably done by an arc welding technique using an aluminum filler rod and a shield of inert gas such as argon. When using the above arc welding technique, the preheating temperature should vary from 375° to 425° F.

Welding is preferably done by means of a fillet weld placed at the threaded junction so as to seal such junction and thus prevent deterioration of the junction due to electrolytic corrosion and chemical attacks. It is also preferable to chamfer the contact buttons at the threaded junction as to permit the insertion of a suitable fillet of brazing alloy between the contact button and the headbar.

The invention will now be disclosed by way of example with reference to the accompanying drawings wherein.

Figure 1:
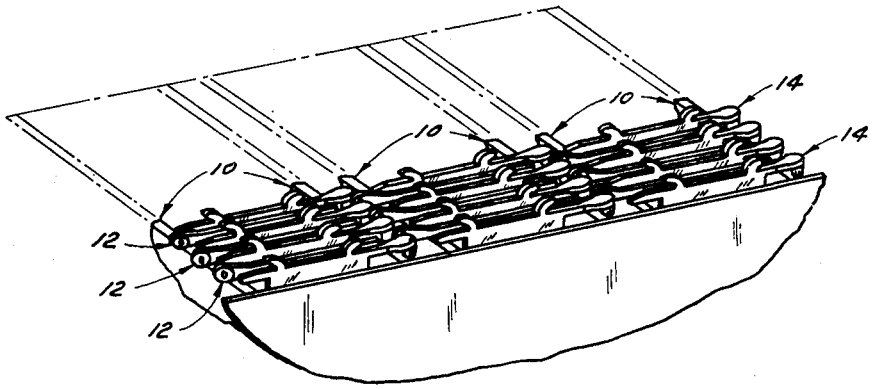
FIG. 1 illustrates a perspective view of a bank of electrolytic cells wherein interspaced cathodes and anodes are located and wherein the anodes of one cell are connected in series with the cathodes of the adjacent cell.

Referring to FIG. 1, there is shown a bank of electrolytic cells comprising a plurality of cells 10 each containing plural interspaced anodes 12 and cathodes 14. The cells 10 extend the full width of the bank and the anodes of one cell are connected to the cathodes of the adjacent cell.

Figure 2:
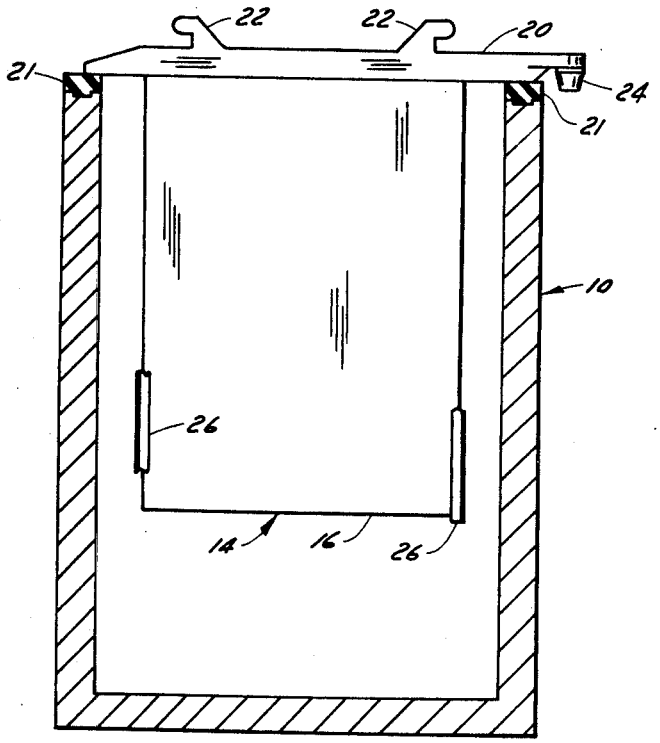
FIG. 2 illustrates a side view of a cathode structure incorporating an aluminum headbar onto which is secured a contact cone which is threaded into the headbar and welded thereto.

As shown in FIG. 2, each cathode consists of a rectangular plate of rolled aluminum 16 adapted to be suspended into the electrolytic cell 10 by means of a cast headbar 20 which is welded to plate 16 by any suitable welding method but preferably arc welding using an aluminum alloy filler rod in a shield of inert gas such as argon. The headbar is electrically insulated from the cell by means of longitudinal strips 21 made of polyester material. The headbar is normally made of an aluminum aloy containing 5 to 6% silicon to facilitate casting and to improve the rigidity thereof. Each headbar is provided with two hooks 22 which are used for withdrawing the cathodes from the cells and replacing the same by new ones. A contact button 24 of tough pitch electrolytic copper made in the form of a truncated cone and provided with a threaded stud 25 is threaded into the end of each cathode and welded thereto in accordance with the method of the present invention which will be disclosed in detail in a later part of the description. A plastic sheet 26 is stuck along both edges of the cathode plate 16, in known manner, so as to permit easy removal of the material deposited on the plate during the electrolytic process.

Figure 3:
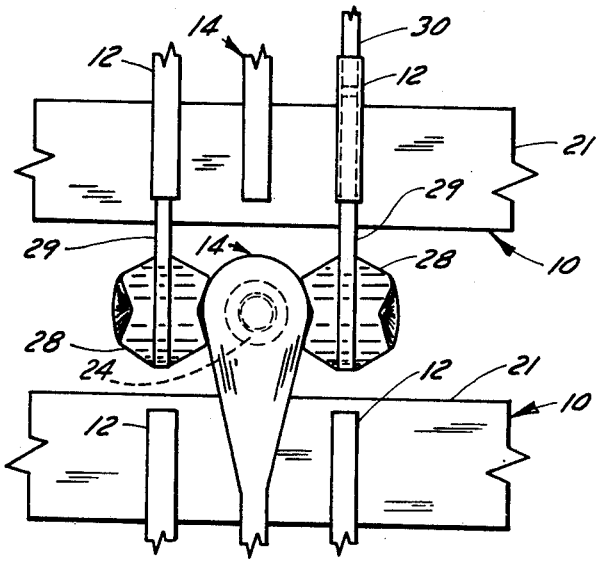
FIG. 3 illustrates how the connections are made from a cathode in one cell to two adjacent anodes in an adjacent cell so as to connect the electrodes of adjacent cells in series.

Referring to FIG. 3, there is shown an enlarged partial view of two adjacent cells 10 for the purpose of illustrating how the anodes 12 are connected to the cathodes 14. Each anode is provided with a copper contact 28 which is integral with a copper extension 29 thermally fused with a sliver-copper alloy to the main copper bar 30 of the anode. Such extension and the main copper bar are covered with lead to make up the lead anodes in known manner. Each side of the copper contact 28 has an inward radius of curvature which corresponds substantially to the one of the contact cone 24 so as to provide good electrical contact between the two elements.

Figure 4:
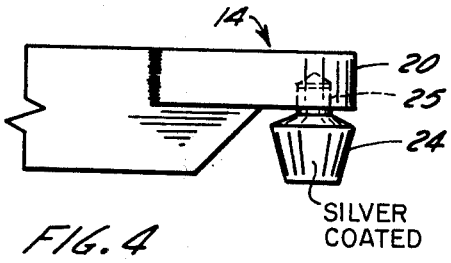
FIG. 4 illustrates an enlarged view of the copper cone threaded into the headbar.
Figure 6:
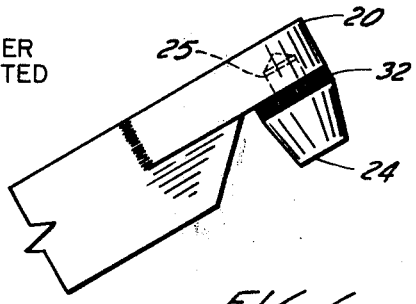
FIG. 6 illustrates an enlarged view of the copper cone and headbar after the second welding pass.
Figure 5:
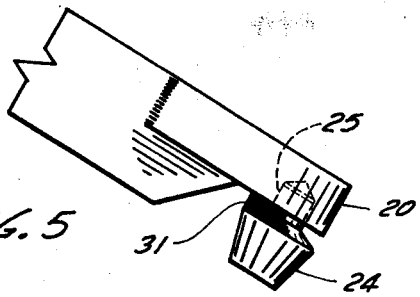
FIG. 5 illustrates an enlarged view of the copper cone and headbar after the first welding pass.

The reinforced mechanical joint between the copper cone 24 and the headbar will now be disclosed with reference to FIGS. 4–6. During manufacture, the copper cone 24 is chamfered at an angle of about 45° around the stud 25 so as to permit the insertion of a good fillet of brazing alloy between the cone and the headbar as it will be seen later. A shoulder of 1/16 to ⅛ of an inch should also remain on the stud of the cone to protect the threaded portion of the cone from excessive penetration into the headbar. Prior to being threaded into the headbar, the cone is brushed with a wire brush to remove the oxides and generally to clean the same. The cone is subsequently plated with a thin coating of silver by dipping it in a bath of silver cyanite for a time interval of 3 to 5 seconds at a temperature of 170°–190° F. After removal of the cone from the bath, it is rinsed properly and dried. On completion of the silver plating process, the cone is mechanically threaded into the aluminum headbar as illustrated in FIG. 4. The minimum torque used should be approximately 90 ft-lbs. A non-oxide hydrocarbon grease may be used to lubricate the threads but such grease must be a conductive grease so as not to electrically insulate the threaded connection. Prior to threading the cone 24 into the headbar, the areas of the headbar where welding is performed should be grinded and/or wire brushed to remove the oxides and generally clean the headbar. The assembly of the headbar and cone is then preheated to a temperature varying between 200° and 900° F. depending on the welding method used. During heating, a contact pyrometer may be used to monitor the temperature of the assembly.

As illustrated in FIG. 5, the headbar is then positioned at an angle of about 45° with the horizontal with the cone 24 facing down and a first welding pass 31 is done in the region where the headbar extends. Welding is preferably done using the well known MIG method. Such method involves the use of an arc welding torch utilizing an aluminum alloy filler rod and an inert gas shield such as argon. The filler rod must be made of an alloy which is compatible with the material of the headbar (aluminum containing about 5–6% silicon) and of the contact button (tough pitch electrolytic copper). When using such a welding method the preheating temperature should preferably be between 375° and 425° F. During welding, the torch is directed at the copper cone so as to avoid overheating of the aluminum which has a lower fusion point then copper. The first pass is normally done in two steps to deposit a fillet of brazing alloy around the portion of the headbar cone assembly which extends in the area of the headbar. It will be understood that the two steps are required because of the difficulty in welding between the headbar and the cone. In a first step a fillet is deposited from one side of the headbar and in a second step from the other side of the headbar so as to cover approximately all the area of the headbar cone assembly which extends underneath the headbar. It will be understood that the cone is chamfered, as mentioned previously, so as to permit the insertion of a good fillet of brazing alloy between the cone and the headbar.

As illustrated in FIG. 6, the headbar is then tilted so that the cone carrying end is up and a second pass 32 is made between the cone and the headbar to complete the fillet weld all around. The welded assembly is then allowed to cool slowly in asbestos powder, for example. It is then inspected for distortion and tested from a mechanical and an electrical point of view.

Although the MIG process is preferably used to weld the cone to the headbar, it is to be understood that oxy-acetelene welding could also be used. However, the MIG welding is better because it has less effect on base metals and thus requires less preheating. Less alloying has also been experienced with the MIG process resulting in stronger joints. Furthermore, the MIG process provides a quicker weld and there is no interference from oxygen in the copper due to diffusion or from grease in the threads.

Plug welding from the top of the headbar has also been experimented with. This was done by drilling and chamferring of the top portion of the headbar. However, fillet welding around the headbar was preferred to plug welding from the top because more welded surface area was obtained and thus higher strength and conductivity. Fillet welding also provides a seal for the threaded connection and thus prevents electrolytic corrosion and chemical attack of the threaded connection. Finally, the welds in the area around the cone provide higher resistance to shear loads.

Half sections were cut through the center of preselected cone and headbar assemblies and submitted to various metallurgical tests. The following results were noted:

1. The mechanical bond of the threaded joint was not affected by welding. Thus any mechanical strength obtained by welding in addition to the low resistance bond is added to the strength achieved by the threaded joint.

2. Micrographs did not reveal any heat affected zones in the copper cone. The properties of the copper cone were maintained. Therefore no change in the conductivity or strength of the cone is expected.

3. There was fusion between the cone and the filler alloy and thus a metallurgical bond therebetween. The fusion was proven by the alloy presence. No porosity or inclusions were revealed in the photo micrographs. 4. The alloy layer was measured on the micrographs and ranged from 0.0001 to 0.0003 inch in thickness. The alloy conductivity could vary from 7 to 40% of copper depending on the alloy percentage and phases. It is estimated that at 0.0003 inch and 7% conductivity (the worst condition) the joint electrical resistivity would be $1.43 \times 10^{-11}$ ohm per square inch area. It was also estimated that the welded joint (fusion area) was 0.7 square inch for the plug weld and 1.5 square inches for the fillet weld around the cone. Therefore, the total calculated resistivity of the joint for the fillet weld was $0.95 \times 10^{-11}$ ohm and for the plug weld $2.5 \times 10^{-11}$ ohm. In both cases, the resistance may be considered negligible and welding improved the contact between the cone and the headbar.

The main features of the above described method are silver plating and preheating of the copper cones. Silver plating is necessary for a strong electrical and metallurgical bond between copper and aluminum. Preheating is also essential because of the differences in thermal conductivities and melting points between aluminum and copper. Moreover, the preheating temperature of 375° to 425° F using the MIG welding method is critical because the fusion of copper and aluminum must be rapid to preclude oxygen diffusion from the copper cone. If rapid fusion is not achieved, the aluminum will overheat and destroy the metallurgical bond.

Although the headbar has been mainly referred to in the above description as being made of aluminum, it is to be understood that it may be made of extruded pure aluminum or of a cast aluminum aloy containing any other suitable metal which could improve its mechanical or electrical properties, or facilitate manufacturing thereof. For example, as mentioned previously, the headbar may advantageously be made of a cast aluminum alloy containing 5–6% silicon to improve its rigidity and facilitate casting.

What is claimed is:

1. A method of joining a copper contact button to the aluminum or aluminum alloy headbar of an electrode plate, comprising the steps of:

a. coating the copper contact button with a thin layer of silver;

b. mechanically threading the copper contact button into the aluminum or aluminum alloy headbar;

c. preheating the assembled silver coated copper button and aluminum or aluminum alloy headbar to a temperature ranging from 375° to 475° F for the purpose of achieving rapid fusion of copper and aluminum, and for preventing overheating of aluminum and diffusion of oxygen from the copper button into the weld; and d. welding the coated copper contact button to the preheated aluminum or aluminum alloy headbar, after said preheating, and by an arc welding technique using an aluminum alloy filler rod and a shield of inert gas, whereby the strong mechanical joint provided by the threaded connection is reinforced by a strong metallurgical bond having a low electrical contact resistance.

2. A method as defined in claim 1, wherein welding is done by means of a fillet weld placed at the threaded junction so as to seal such junction and prevent deterioration of the junction due to electrolytic corrosion and chemical attack.

3. A method as defined in claim 2, wherein the cone is chamfered so as to permit the insertion of a suitable fillet of brazing alloy between the contact button and the headbar.

* * * * *